United States Patent [19]

Thomas et al.

[11] 4,231,577

[45] Nov. 4, 1980

[54] ELECTRICAL GAME APPARATUS USING FOLD SWITCH MATRICES

[76] Inventors: Wendl Thomas, 55 Dinsmore Ave., Framingham, Mass. 01701; Holly T. Doyle; Robert O. Doyle, both of 77 Huron Ave., Cambridge, Mass. 02138

[21] Appl. No.: 877,797

[22] Filed: Feb. 14, 1978

[51] Int. Cl.[2] ..... A63F 3/00

[52] U.S. Cl. ..... 273/238; 273/265; 273/282; 273/275

[58] Field of Search ..... 273/238, 102.2 R, 265; 35/9 C, 5; 200/5 A

[56] References Cited

U.S. PATENT DOCUMENTS

| | | | |
|---|---|---|---|
| 3,085,803 | 4/1963 | Krzes | 273/238 |
| 3,757,322 | 9/1973 | Barkan | 35/6 |
| 4,066,851 | 1/1978 | White | 200/5 A |
| 4,096,577 | 6/1978 | Ferber | 200/5 A |

FOREIGN PATENT DOCUMENTS

| | | | |
|---|---|---|---|
| 1431792 | of 1966 | France | 273/238 |
| 1534876 | of 1968 | France | 273/238 |

*Primary Examiner*—Richard C. Pinkham
*Assistant Examiner*—Carl Moy
*Attorney, Agent, or Firm*—Kenway & Jenney

[57] ABSTRACT

Two playing boards with a matrix array of apertures are positioned so that one board only is displayed to each player. Electric circuitry including contacts are printed on one side of a flexible sheet which is folded so that contacts face each other adjacent each of the apertures. The circuitry is arranged so that the insertion of plugs into corresponding apertures of the two boards moves the contacts carried on the sheet towards each other to close a circuit energizing an audible signal generator.

1 Claim, 7 Drawing Figures

FIG 1
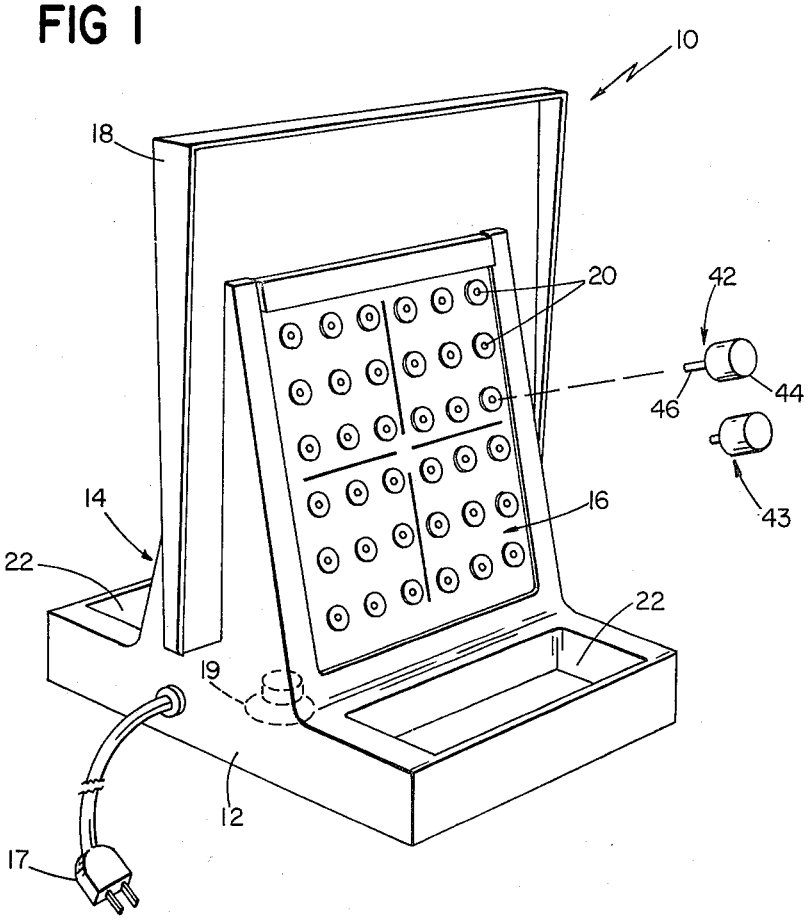
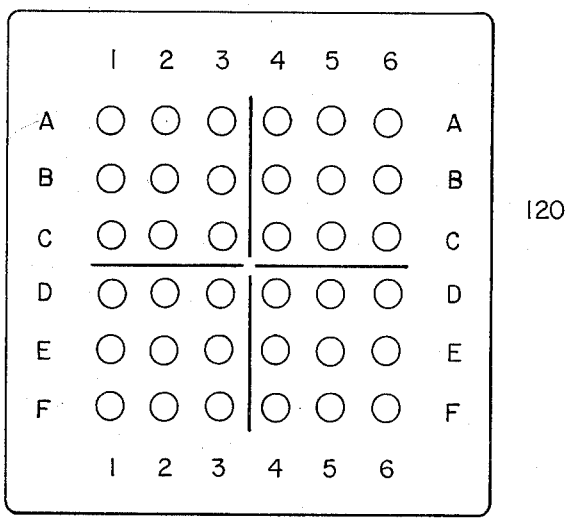
FIG 2

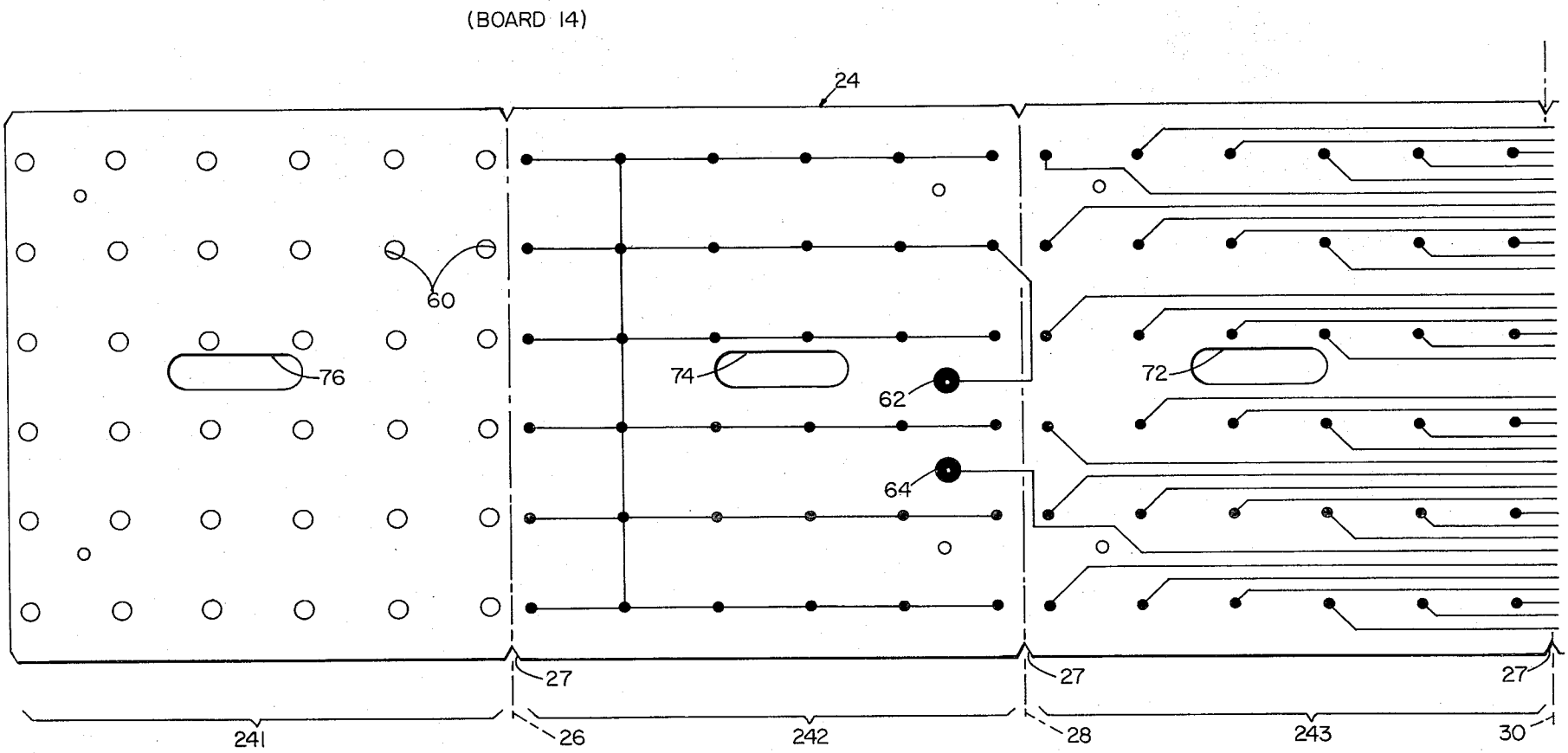
FIG 3a
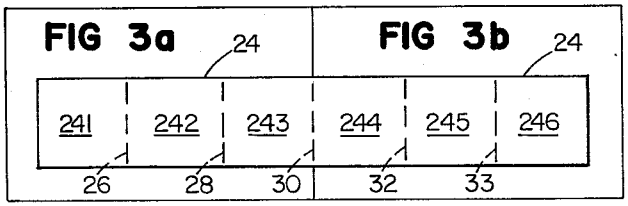

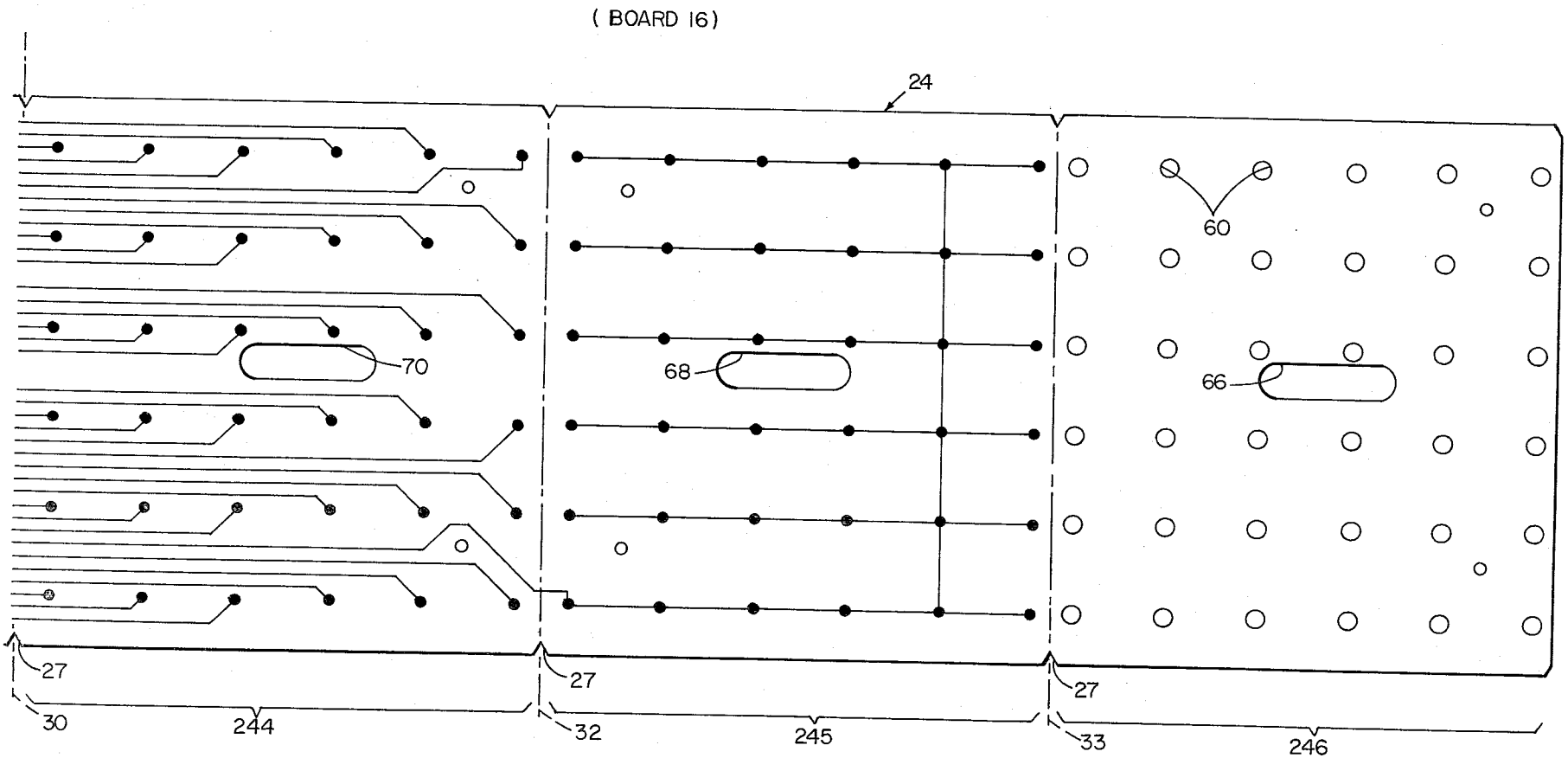
FIG 3b
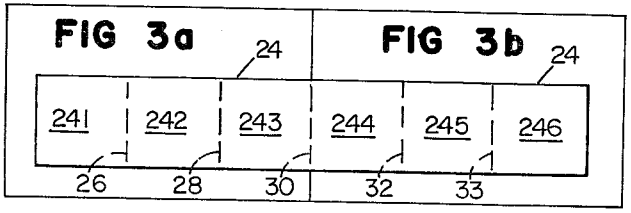

FIG 4
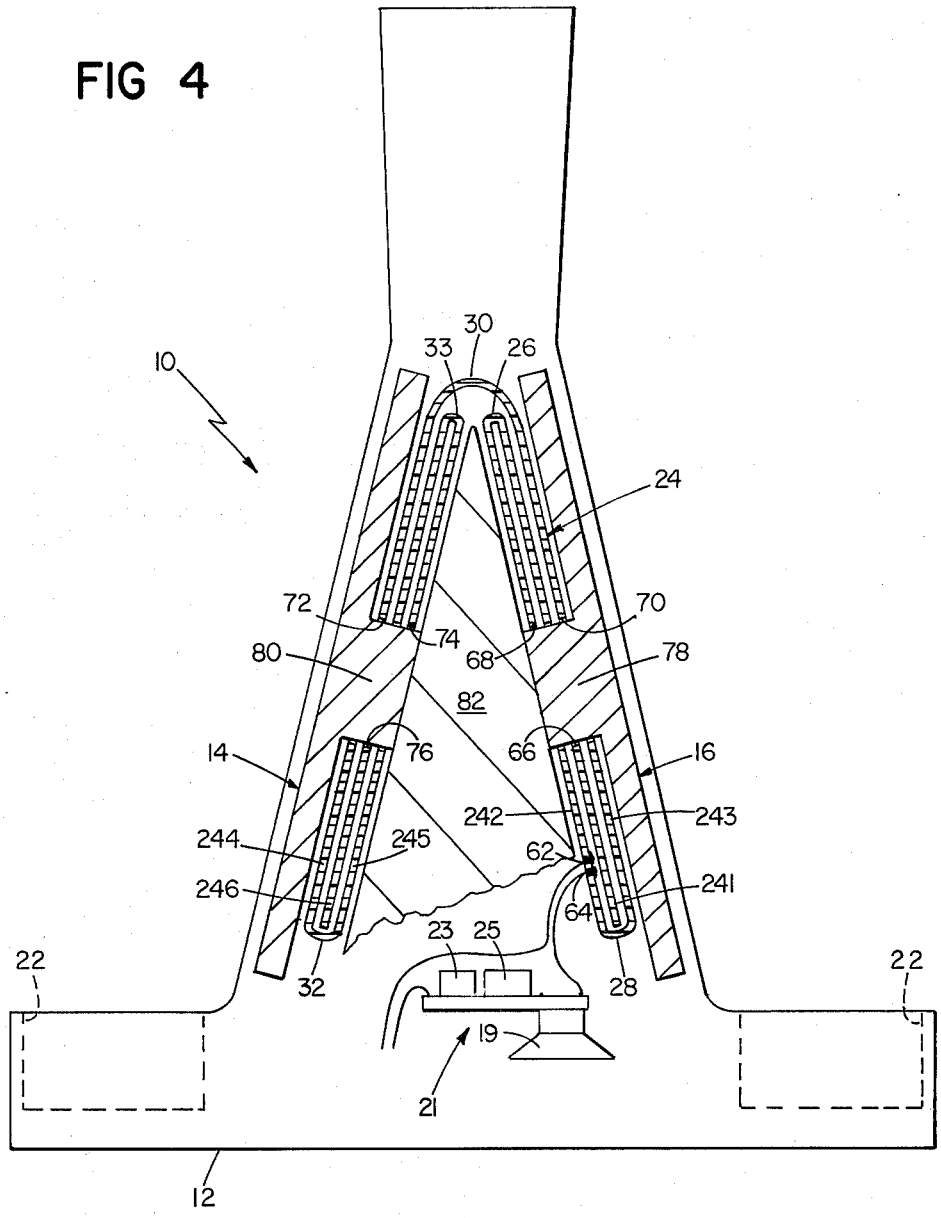
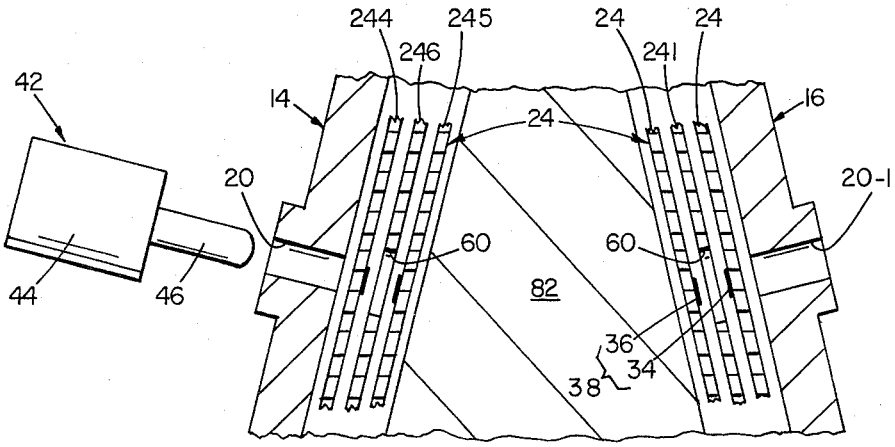
FIG 5

ELECTRICAL GAME APPARATUS USING FOLD SWITCH MATRICES

This invention relates to game apparatus.

According to the invention, the apparatus comprises an enclosure including a board for each of two players, and shield means maintaining each board visible to its player and invisible to the other player. Each board provides a plurality of apertures defining an aperture matrix array, each aperture in an aperture matrix array corresponding with a single aperture in the other aperture matrix array.

The apparatus further comprises flexible sheet means carried in the enclosure and including fixed and movable portions, electrical circuit means within the enclosure, including a plurality of switches, each said switch comprising a fixed contact carried on the flexible sheet fixed portion and a movable contact carried on the flexible sheet movable portion. The plurality of switches define two switch matrix arrays each corresponding to an aperture matrix array, each switch being disposed adjacent an aperture.

The apparatus provides power source connecting means for connecting a power source to the electrical circuit means, and signal means mounted on the enclosure and connected to the electrical circuit means, responsive to a closed circuit condition between the signal means and the power source connecting means for producing a signal during the continuance of said condition simultaneously perceptible to both players.

The electrical circuit means provides a conductor connected between one side of each of every two corresponding switches, the other sides of the corresponding switches being connected respectively to the power source connecting means and the signal means. A plurality of plug pieces are provided, each removably insertable in any of the apertures and maintainable therein by interference fit therewith, each plug piece including means for actuating the switch corresponding to the aperture. The presence of a plug piece in each of two corresponding apertures in the aperture matrix arrays provides a continuing closed circuit condition between the power source connecting means and the signal means, whereby a continuing perceptible signal indicates to both players the presence of a plug piece in each of two corresponding apertures.

In preferred embodiments, the game apparatus enclosure includes sheet support structure disposed adjacent and inwardly of each board and generally parallel therewith, and each board provides on its inward surface an alignment boss extending inwardly toward the sheet support structure. The apparatus further comprises an electrically insulating flexible sheet member carrying electrical circuit and contact elements on a single surface thereof; the sheet is folded to define a plurality of regions comprising first and second fixed contact carrying regions, first and second movable contact carrying regions, and first and second spacing regions free of circuit elements and providing contact apertures. Each region has an alignment slot therein.

The first fixed and movable contact carrying regions are disposed adjacent one another with the first spacing region therebetween; the movable contact elements are engagable with the fixed contact elements through the contact apertures. The first spacing region normally maintains the movable and fixed contacts spaced apart. The alignment slots of the first fixed and movable contact carrying regions and of the first spacing region are aligned with one another and cooperate with an alignment boss positively to position the fixed and movable contact elements with respect to each other and to the contact apertures, and positively to position the three first regions with respect to a first board and its aperture matrix array. The second fixed and movable contact carrying regions and second spacing region are similarly disposed.

The electrical circuit and contact elements carried on the sheet surface define the electrical circuit means; the plurality of switches define two switch matrix arrays each corresponding to an aperture matrix array of a board, each switch being disposed adjacent an aperture. The plug piece means for actuating a switch comprises sheet flexing means extending through the aperture when the plug piece is inserted therein and engaging a sheet movable contact carrying region for moving the region toward the adjacent fixed contact carrying region supported on the sheet support structure, for engagement of a fixed contact by a movable contact through a contact aperture.

Other objects, features and advantages will appear from the following description of a preferred embodiment of the invention, taken together with the attached drawings thereof, in which:

FIG. 1 is an illustrative view of the exterior of the game apparatus of the invention together with two representative removable pieces;

FIG. 2 is a plan view of an aperture matrix array of the apparatus;

Figure 6:
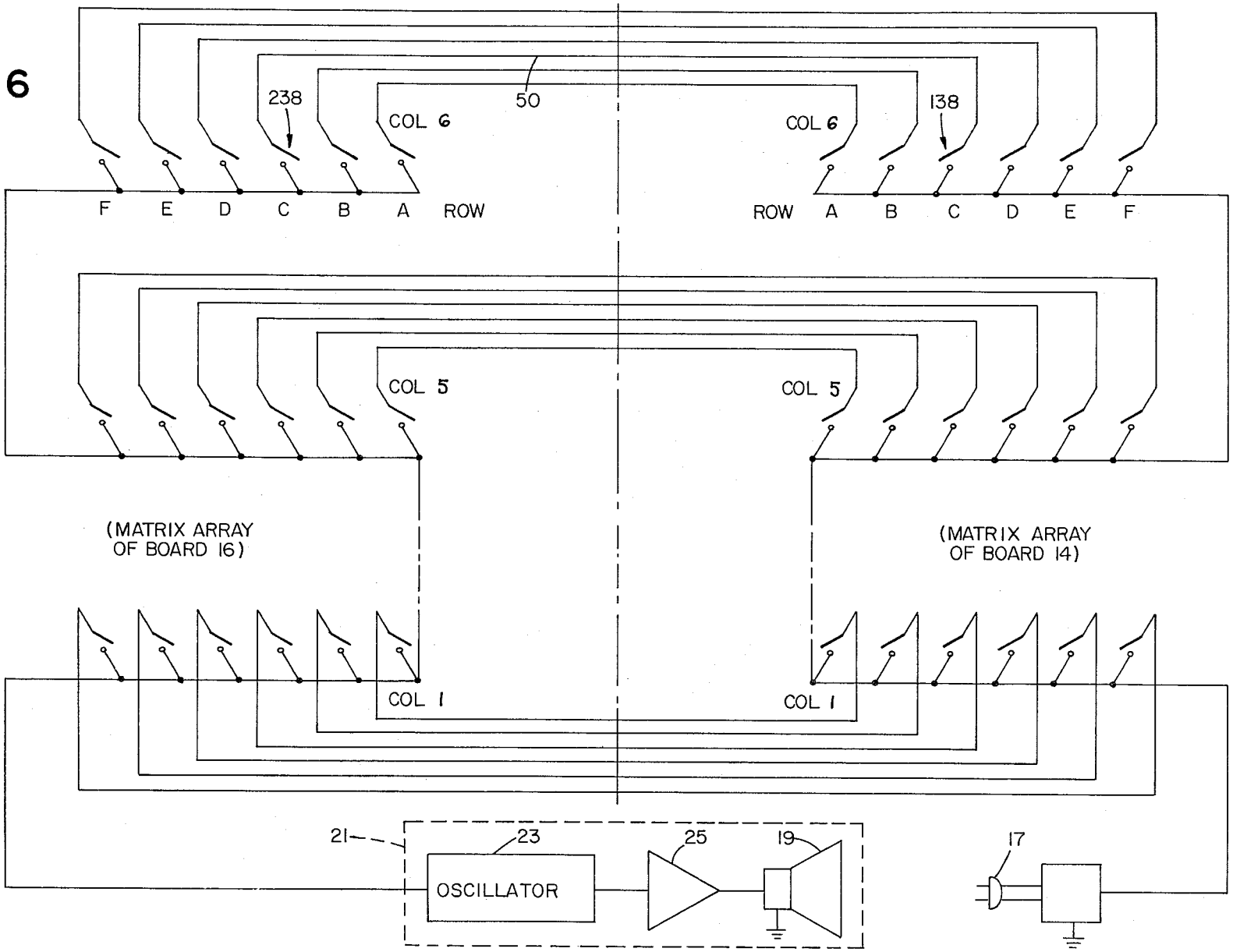

FIGS. 3*a* and 3*b* together comprise a plan view of the printed circuit element of the preferred embodiment of the apparatus of the invention;

FIG. 4 is a diagrammatic cross sectional view through the apparatus taken on the line 4—4 of FIG. 1, with portions omitted for clarity;

FIG. 5 is a greatly enlarged detailed view of portions of the apparatus;

FIG. 6 is a circuit diagram of the apparatus of the invention.

Referring now to the drawings, and particularly to FIG. 1, the game apparatus of the invention comprises an enclosure 10 having a base 12 and two slanted board portions 14 and 16. In the preferred embodiment described herein, enclosure 10 is made of a molded plastic or other suitable material. The board portions 14 and 16 are arranged so that each player can see only his own board. Shield portion 18 is provided to further prevent each player from seeing the other player's board.

A signal means having a speaker 19 is mounted in the enclosure 10, and in certain conditions of play, to be described more fully in what follows, the signal means provides a signal that is simultaneously audible to both players. Other signal means might be employed, as for instance means to illuminate a light placed in a position to be visible simultaneously to both players.

A power source connecting means comprising a plug 17 is provided, attached to enclosure 10, to be connected to a source of power. Alternatively, the enclosure might provide means for receiving electric batteries.

Each board portion provides a plurality of apertures 20, arranged to define an aperture matrix array, which in the particular embodiment described is a six-by-six matrix, but which may be of any convenient number of rows and columns. The position of each aperture is uniquely defined by naming its row and column. FIG. 2 shows an aperture matrix array with the rows indicated by letters and the columns by numbers. In alternative embodiments, the array positions might be defined in polar coordinates rather than in rectangular coordinates as shown here.

A matrix array of normally open electric swiches, to be described, underlies each aperture matrix array. A single switch corresponds to each aperture.

A plurality (at least as many as the number of apertures in an aperture matrix array) of electrically non-conducting plug pieces or pegs 42 (FIG. 1) are provided for each player, each plug piece 42 having a relatively enlarged handle end 44 and a relatively smaller actuating end 46 extending beyond the handle. When a plug piece 42 is inserted into an aperture 20 of board 14 or 16, actuating end 46 closes the switch lying immediately below the aperature, in a manner to be described more fully below. The switch is maintained closed as long as the plug remains in the aperture. The plug is maintained in position by an interference fit with the aperture and is readily removable. Alternatively, the plug may be removably maintained in the aperture by, for example, spring means in the aperture biassed inwardly toward the plug.

In addition, for use in certain games, the game apparatus includes a plurality of "marker" pieces 43 (FIG. 1), which are removably insertable in the apertures but which do not have an actuating end. Such marker pieces are used to mark apertures where the insertion of a plug piece has resulted, at an earlier stage of the game, in the production of the signal, as will be described.

A receptacle 22 for holding the plug and marker pieces is provided for each player adjacent his board. A cover may be provided for the receptacle.

Each aperture 20 in the aperture matrix array of board 14 corresponds with an aperture in the aperture matrix array of the other board 16. The correspondence is defined in this embodiment of the invention by the position in the matrix, that is, the aperture at Row C, Column 6 of board 14 (identified by reference numeral 120 in FIG. 2) corresponds with the aperture at that same position of board 16. Likewise, the electric switch provided adjacent any particular aperture of board 14 corresponds with the switch provided adjacent the corresponding aperture of board 16.

Referring now particularly to FIG. 6, the circuit diagram of the electrical circuit means of the game apparatus is shown in schematic form. The switches of the matrix array of board 14 are shown on the right, columns 2, 3 and 4 being omitted in the Figure. The switches of the matrix array of board 16 are shown on the left, columns 2, 3 and 4 being likewise omitted. Switch 138, in the position defined as Row C, Column 6 of the matrix array of board 14, corresponds with switch 238, in the position defined as Row A, Column 4 of the matrix array of board 16. The electrical circuit means provides a conductor 50 connected between one side of switch 138 and one side of the corresponding switch 238; the other sides of the corresponding switches 138 and 238 are connected respectively to the power source connecting means and the signal means. If both switches 138 and 238 are closed by the insertion of plug pieces 42 through the corresponding apertures of the respective boards, the circuit from the power source to the signal means is closed and the signal means responds to this closed circuit condition by producing a signal.

In this embodiment of the invention, signal means 21 comprises the speaker 19, together with oscillator 23 and amplifier 25 (FIGS. 1 and 6). Signal means 21 operates to provide a rapid succession of beeps during the continuance of the closed circuit condition. To stop this signal, one or the other of the corresponding plug pieces 42 must be removed by the player who inserted it. According to the rules of the particular game being played, either player may be required to remove his plug piece and in some cases other plug pieces as well.

In addition to conductor 50 between the two corresponding switches 138 and 238, the electrical circuit means of the game apparatus of the invention provides further conductors, including a conductor between one side of each switch in the matrix array of board 14 and one side of its corresponding switch in the matrix array of board 16, the other sides of the corresponding switches being respectively connected to the power source connecting means and the signal means. Therefore, the signal means is responsive to a closed circuit condition resulting from the insertion of plug pieces in any two corresponding apertures.

In the preferred embodiment of the invention, the electrical circuit means is provided in the form of printed circuit elements on a single insulating sheet. Referring now to FIGS. 3*a* and 3*b*, a flexible sheet element 24 of mylar carries printed conducting circuit elements on one surface only. Suitable methods of making such a printed circuit element are well known and will not be described here. Fold line indicia 27 are provided on sheet element 24 along with the circuit elements during manufacture, and indicate the positions of fold lines 26, 28, 30, 32, and 33. Central fold line 30 defines the division between the switch matrix arrays of board 14 and board 16, as seen in FIG. 6. The remaining fold lines divide sheet element 24 into the six regions 241, 242, 243, 244, 245 and 246.

End portions 241 and 246, lying at the two ends of sheet element 24, carry no printed circuit elements. However, each portion provides an array of spacing apertures 60 in positions corresponding to an aperture array on board 14 or 16. Portions 242 and 245 carry the fixed contacts of the two switch matrix arrays, and portions 243 and 244 carry the movable contacts thereof. Two contact pads 62 and 64 are provided in portion 242 for connection to the power source and speaker means. Each of the six portions provides an alignment slot 66, 68, 70, 72, 74 and 76. The alignment slots and the spacing apertures are made in the sheet during its manufacture to ensure proper spacing between these elements and the conducting elements.

Referring now to FIG. 4, sheet element 24 is folded along the indicated fold lines in such a manner that all the cooperating conducting elements printed thereon are disposed adjacent one another; that is, portion 242 is folded toward portion 243 with their contact elements on their adjacent inward surfaces. End portion 241 is folded at line 26 to lie between portions 241 and 243, with its array of spacing apertures lying between, and in registration with, the adjacent paired fixed and movable contacts. Similarly, portion 245 is folded toward portion 244, with end portion 246 lying therebetween.

When sheet element 24 is folded for insertion into enclosure 10, the three alignment slots 66, 68 and 70 (FIG. 3*a*) overlie one another, as do the three alignment slots 72, 74, and 76. The interior surface of board 14 provides alignment means in the form of a boss 80, over which the slots 72, 74, and 76 are snapped to maintain the pairs of switch contacts and the spacing apertures in correct orientation with respect to each other and to the aperture matrix array of board 14 (FIG. 4). Similarly, the interior surface of board 16 provides an alignment boss 78, over which the slots 66, 68, and 70 are snapped to position the remaining portions of sheet 24 with respect to each other and to the aperture matrix array of board 16. An inflexible support structure 82 is provided within enclosure 10 underlying each of boards 14 and 16. The folded portions of the printed circuit sheet are confined between the boards and the support surfaces. In this condition, end portions 241 and 246 of folded sheet 24 serve as spacer and insulating means, spacing apart the two adjacent circuit-carrying surfaces of each switch matrix array and normally maintaining the switches in an open condition.

Referring now to the enlarged view of FIG. 5, a single aperture 20-1 in the aperture marix array of board 16 is shown. Spacing and thickness of the parts has been exaggerated in this figure. The portion 243 of sheet 24 lying immediately beneath aperture 20-1 carries a movable switch contact 34 on the surface removed from aperture 20-1, and the further folded portion 242 carries the other fixed contact 36 which together with contact 34 comprises a particular switch 38 corresponding to aperture 20-1.

Spacer means 241 (end portion 241) lies between portions 242 and 243 of sheet 24, as seen in FIG. 4. Portion 241 provides an array of contact apertures 60 (FIG. 3*a*) corresponding to the apertures 20 of the aperture matrix array of board 16. The spacing, dimensions and flexibility of the mylar sheet are such that, in the absence of plug pieces, the presence of the spacer means 241 maintains the two circuit-carrying portions 242 and 243 of sheet element 24 sufficiently spaced apart that the adjacent contact elements of each switch do not engage one another through contact apertures 60. However, the mylar sheet is sufficiently flexible so that, when a plug member or peg 42 is inserted through aperture 20-1 in board 16, contact 34 carried on portion 243 is moved through aperture 40 of spacer portion 241 by a sufficient distance that it engages fixed contact 36 on portion 242, supported against the surface of support structure 82. Switch 38 is thereby closed. When the plug is removed, sheet portion 243 moves away from portion 242 and the switch returns to its normally open condition.

A wide variety of games may be played with the game apparatus of the invention. An example of such a game is called "Battle of the Blobs".

The object of the game is to wipe out the other player's "blob." For this game, each aperture matrix array is regarded as divided into four square regions, as indicated by crossed lines in FIG. 2. To set up the apparatus for the game, one player places seven pegs anywhere in the upper half of his board, his selection being hidden from the other player. The other player places seven pegs anywhere in the lower half of his board, likewise in secret. The limitation on initial placement of a player's pegs is that each player's pegs must all be contiguous; that is , each peg must be placed adjacent at least one other peg, horizontally, vertically or diagonally, so that the player's pegs form a "blob".

To play, the players take turns adding one peg at a time. Each added peg must be ajacent at least one other previously placed peg. If the newly added peg does not produce a signal from the signal means, it may be left is place. If it does produce a signal, the player placing the peg must announce its position, referring to the row and column designations of FIG. 2. The opposing player must remove his peg from the corresponding aperture, and must remove all pegs that are adjacent to the removed peg.

If a player's blob is separated by such removal into two or more parts, any part reduced to a single peg must be removed. When a player's entire blob is reduced to a single peg, the player loses.

An example of another game, employing the apparatus of the invention including the "marker" pieces 43, is "Connections."

The object of the game is to be the first player to form a path of pegs that connects at least one position on each of the four outer sides of the aperture matrix array. A path is defined as connected horizontally or vertically; diagonal connections do not count as part of a path. A corner aperture connects the two adjacent sides. The rules of play are that the players take turns, each placing one peg at a turn; a player may place a peg in any empty position; if the inserted peg does not activate the signal means, it may be left in place; if the inserted peg activates the signal means, it is left in place and the player announces its position to the other player, who must remove his corresponding peg and replace it with a marker, which remains in place for the duration of the game. If at his turn a player has no empty positions (apertures having neither a peg nor a marker in them) into which he can place a peg, he must stop playing, while the opposing player, if he is able, may continue to place pegs. The winner is the first to form a path that is connected horizontally and vertically and that touches each of the four outer sides of the aperture matrix array.

Modifications of the game apparatus of the invention which has been described with be apparent to those skilled in the art. As previously mentioned, the signal may be a light rather than a sound. Further, the plug piece or peg need not be non-conducting; the switches may be so designed that a circuit is closed by the insertion of a plug piece having a conducting portion or wholly conductive if the current involved is small. Alternative structures for the switch may be employed.

What is claimed is:

1. Game apparatus, comprising an enclosure including first and second boards, one for each of two players, and shield means maintaining each board visible to its player and invisible to the other player, said boards being positioned with at least one edge adjacent to a corresponding edge on the other board, each board being positioned in a substantially vertical plane, each board providing a plurality of apertures extending therethrough defining an aperture matrix array, each aperture in a said aperture matrix array corresponding with a single aperture in the other said aperture matrix array, said enclosure including sheet support structure disposed adjacent and inwardly of each said board and generally parallel therewith, each said board providing on its inward surface an alignment boss extending inwardly toward said sheet support structure, a flexible sheet member carried in said enclosure and carrying electrical circuit means on a single surface thereof, said sheet being folded to define a plurality of regions comprising, first and second fixed contact carrying regions, first and second movable contact carrying regions, and first and second spacing regions free of circuit elements and providing contact apertures, each said region having an alignment slot therein, said first fixed and movable contact carrying regions being disposed adjacent one another with said first spacing regions therebetween, said movable contact elements being engageable with said fixed contact elements through said contact apertures, said first spacing region normally maintaining said movable and fixed contacts spaced apart, said alignment slots of said first fixed and movable contact carrying regions and said first spacing region being aligned with one another and cooperating with a said alignment boss positively to position said fixed and movable contact elements with respect to each other and to said contact apertures, and positively to position said three first regions with respect to said first board and its aperture matrix array, said sheet member extending across the junction between the said adjacent edges of said boards such that, said second fixed contacts, movable contacts and spacing regions are disposed and aligned with respect to one another and to said second board in the same relationship as said first fixed and movable contact regions and spacing region are disposed and aligned with respect to said first board, said electrical circuit and contact elements carried on said sheet surface defining electrical circuit means including a plurality of switches, said plurality of switches defining two switch matrix arrays, each corresponding to a said aperture matrix array of one of said boards, each said switch being disposed adjacent one of said apertures, power source connecting means for connecting a power source to said electrical circuit means, signal means connected to said electrical circuit means, responsive to a closed circuit position between said signal means and said power source connecting means for producing a signal during the continuance of said condition, said signal being simultaneously perceptible to both players, said electrical circuit means providing a conductor connected between one side of each of every two said corresponding switches, the other side of said corresponding switches being connected respectively to said power source connecting means and said signal means, a plurality of plug pieces each removably insertable in any of said apertures and maintainable therein by inference fit therewith, each said plug piece being formed so that when inserted it actuates the switch corresponding to said aperture and while it remains within said aperture, it maintains said underlying movable contact in engagement with said fixed contact, the presence of a said plug piece in each of two corresponding said apertures in said aperture matrix arrays providing a continuing closed circuit condition between said power source connecting means and said signal means, whereby a continuing perceptible signal indicates to both players the presence of a plug piece in each of two corresponding apertures.

* * * * *

UNITED STATES PATENT AND TRADEMARK OFFICE

CERTIFICATE OF CORRECTION

PATENT NO. : 4,231,577

DATED : November 4, 1980

INVENTOR(S) : Thomas et al.

It is certified that error appears in the above-identified patent and that said Letters Patent are hereby corrected as shown below:

In the heading to the printed specification: "Thomas et al." should be --Thomis et al.--; and directly below the title, inventor "Wendl Thomas" should be --Wendl Thomis--;

Column 8, claim 1, line 20, "inference" should be --interference--.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*